United States Patent [19]

Richardson

[11] 4,227,274

[45] Oct. 14, 1980

[54] PIGGY BACK SKI

[76] Inventor: Richard N. Richardson, 1209 Kiowa Dr. West, Lake Kiowa, Tex. 76240

[21] Appl. No.: 5,398

[22] Filed: Jan. 22, 1979

[51] Int. Cl.[3] ..... A63C 35/29 R

[52] U.S. Cl. ..... 9/310 R

[58] Field of Search ..... 9/310; D21/228-231

[56] References Cited

U.S. PATENT DOCUMENTS

| | | | |
|---|---|---|---|
| 2,955,300 | 10/1960 | Hedlund et al. | 9/310 A |
| 3,094,721 | 6/1963 | Cravotta | 9/310 A |
| 3,118,157 | 1/1964 | Houser | 9/310 AA |
| 3,750,204 | 8/1973 | Walter | 9/310 AA |
| 3,877,097 | 4/1975 | Gentry | 9/310 G |

*Primary Examiner*—Trygve M. Blix
*Assistant Examiner*—Jesus D. Sotelo
*Attorney, Agent, or Firm*—Richards, Harris & Medlock

[57] ABSTRACT

A piggy back ski (10) comprises a first ski section (12) secured to a second ski section (14) by a plurality of releasable fasteners (16). The first ski section (12) includes a foot binding (18) secured thereto. The second ski section (14) can be selectively disengaged during skiing to permit continuation on the first ski section (12). If desired, a releasable fastener (34) can be used to prevent disengagement of the ski sections (12, 14) during skiing.

7 Claims, 6 Drawing Figures

PIGGY BACK SKI

TECHNICAL FIELD

The present invention relates generally to skis. More particularly, this invention concerns a convertible water ski.

BACKGROUND ART

Water skiing is a popular sport. Four basic types of water skis are used; pairs, slalom, trick and shoe skis. Pairs of skis are the easiest to use due to their length and relatively large surface area. The larger area of pairs of skis is particularly advantageous when starting from a position wherein the skier and skis are almost completely immersed in the water: sufficient force is produced at a lower speed to raise the skier out of the water sooner. Slalom skis have approximately half the surface area of pairs of skis, and are more difficult to use. Additional balance and strength are required to use slalom skis, particularly when starting from a standstill in the water. Some pairs of skis are therefore manufactured with two foot bindings on one ski so that the skier can drop a ski once underway and thereafter proceed on the other ski in slalom fashion.

Shoe skis generally have even less surface area than a slalom ski, and are correspondingly more difficult to use. Shoe skis are worn on both feet and comprise short pairs of skis. While a skier can start on a pair of skis and revert to a single slalom ski, this has not been possible heretofore with shoe skis. The difficulty in starting from a dead stop in the water has thus discouraged and even prevented many skiers from using shoe skis. There is thus a need for skis which enable a skier to start on long skis and later convert to shoe skis, if desired, while skiing.

DISCLOSURE OF INVENTION

The present invention comprises a novel piggy back ski which overcomes the foregoing and other disadvantages associated with the prior art. The ski of the present invention permits a skier to get started from a dead stop in the water with less difficulty. Once started, the skier can continue on the long portions of the skis, or drop the long portions of the skis and continue on short shoe skis, as desired. The primary difficulties involved with starting on shoe skis are thus eliminated. The combination of strength, coordination, and balance required to get started on shoe skis is reduced. In addition, the amount of power required to tow the skier is reduced.

More specifically, the present invention comprises a shoe ski detachably secured to the top of a relatively longer ski blank. The shoe ski includes a foot binding and is attached to the ski blank with a plurality of snap fasteners. Preferably, the shoe ski includes a skag which is received in a corresponding slot in the ski blank. The skier starts off using the relatively longer ski blank. Once started, the ski blank can be easily disconnected from the shoe ski. If desired, the shoe ski and the blank ski can be secured against disengagement.

BRIEF DESCRIPTION OF DRAWINGS

A more complete understanding of the invention can be had by referring to the following Detailed Description in conjunction with the accompanying Drawings, wherein.

DETAILED DESCRIPTION

Figure 4:
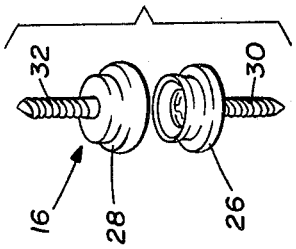
FIG. 4 is an exploded view of a snap fastener useful in the invention.

Referring now to the drawings, wherein like reference numerals designate like or corresponding parts throughout the several views, there is disclosed a piggy back ski 10 incorporating the invention. Normally, of course, a pair of piggy back skis 10 are used by a water skier. The ski 10 is convertible for use between two ski sections of different lengths. As will be more fully described hereinafter, the ski 10 enables a skier to start on relatively larger ski sections and convert to the shorter ski sections after attaining sufficient speed.

Figure 2:
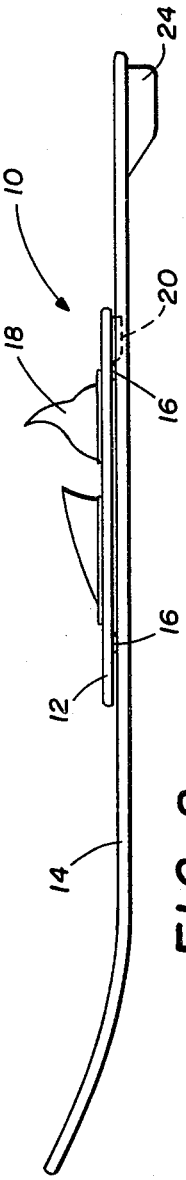
FIG. 2 is a side view of FIG. 1.
Figure 1:
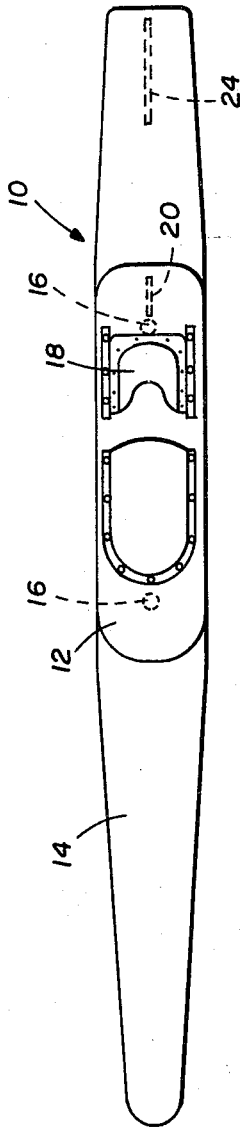
FIG. 1 is a top view of a piggy back ski incorporating the invention.
Figure 3:
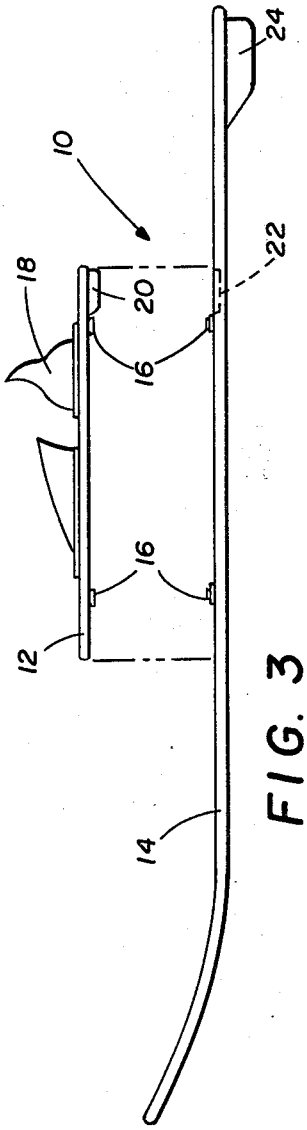
FIG. 3 is an exploded side view of the invention.

FIGS. 1–3 show the constructional details of the piggy back ski 10. The ski 10 comprises a shoe ski 12 removably secured to a ski blank 14 by a plurality of snap fasteners 16. The shoe ski 12 is shorter and of less ski surface area than the ski blank 14. The shoe ski 12 is of conventional construction, and includes a binding 18 mounted on the top surface thereof for receiving one foot of a skier. The foot binding 18 can be of the fixed type or the adjustable type. Preferably, the shoe ski 12 includes a small rear skag 20 extending downwardly from the bottom surface thereof. The skag 20 improves directional control of the shoe ski 12, and is a desirable part of the invention.

The shoe ski 12 is mounted substantially centrally on the top surface of the ski blank 14. A corresponding slot 22, shown in FIG. 3, is provided in the top surface of the ski blank 14 for receiving the skag 20 of the shoe ski 12. The ski blank 14 is curved upwardly at the forward end and skag 24 extends downwardly from the bottom rear surface thereof. The skag 24 facilitates directional control of the piggy back ski 10. The ski blank 14 basically comprises an ordinary water ski minus the foot binding.

Referring to FIG. 4, there is shown an example of one of the snap fasteners 16 suitable for interconnecting the shoe ski 12 and the ski blank 14. The fastener 16 includes a male portion 26 and a female portion 28. The upper part of the male portion 26 is flared slightly outward for engagement with a snap ring (not shown) located inside the female portion 28. One portion of each fastener 16 is attached to the shoe ski 12, while the other portion of the fastener is attached to the ski blank 14. Screws 30 and 32 can be employed to secure the portions of each fastener 16 to the shoe ski 12 and the ski blank 14. Preferably, at least two fasteners 16 located in longitudinally spaced relationship are employed to interconnect the shoe ski 12 and the ski blank 14 as shown in FIGS. 1–3. More snap fasteners 16 can be used depending upon the stiffness of interconnection desired.

In using the piggy back ski 10, the ski is worn just like a conventional ski. Starting from a standstill in the water, however, is facilitated by the relatively larger area of the ski blank 14. After reaching the desired speed, the ski blanks 14 can be disconnected simply by successively lifting each shoe ski 12 away from its corresponding ski blank to jettison the ski blanks in the water and permit continued skiing on the shoe skis only. The stiffness of interconnection between the shoe skis 12 and ski blanks 14 may necessitate a slight jiggle or snapping motion to effect disconnection. The ski blanks 14 can be retrieved later and reconnected to the shoe skis 12.

Figure 5:
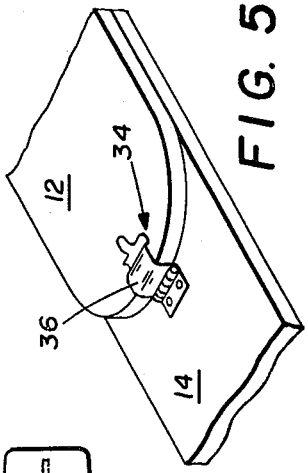
FIG. 5 is an illustration of a modification of the invention.
Figure 6:
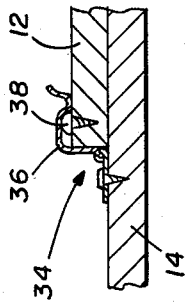
FIG. 6 is a sectional view of the modification shown in FIG. 5.

Referring to FIGS. 5 and 6, there is shown a modification which can be used with the piggy back ski 10. In addition to the fasteners 16 shown in FIGS. 1–4, at least one other releasable fastener 34 can be utilized to inhibit disconnection of the shoe ski 12 and ski blank 14. The fastener 34 includes a spring leaf 36 which can be selectively engaged over a protrusion 38 secured to the shoe ski 12. One such fastener 34 can be provided at each end of the shoe ski 12, although only one fastener located at the forward end of the shoe ski is shown for purposes of illustration. When the fastener 34 is engaged, the ski sections of the piggy back ski 10 cannot become disconnected such that the piggy back ski functions as an ordinary ski. The fastener 34 can be readily disengaged to enable convertible operation of the piggy back ski 10 again.

From the foregoing, it will be evident that the present invention comprises a novel piggy back ski having numerous advantages over the prior art. The ski can be readily converted from an ordinary water ski to a relatively shorter shoe ski while skiing. This enables the advantages of a relatively larger ski to be used when starting from a standstill in the water. Other advantages will suggest themselves to those skilled in the art.

Although particular embodiments of the invention have been illustrated in the accompanying Drawings and described in the foregoing Detailed Description, it will be understood that the invention is not limited to the embodiments disclosed, but is intended to embrace any alternatives, modifications and rearrangements and/or substitutions of parts or elements as fall within the spirit and scope of the invention.

I claim:

1. In a water ski of the shoe type having a relatively short length with a foot binding mounted thereon, the improvement comprising:

a relatively longer ski blank located beneath the ski and extending parallel to said ski;

a downwardly projecting first skag secured to the rear of the ski blank for directional stability; and means for snap-releasably interconnecting the ski and the ski blank such that said ski blank can be released by a skier while underway, thereby allowing the skier to proceed on said ski alone.

2. The water ski of claim 1, wherein the improvement includes:

a downwardly projecting second skag attached to the rear of the ski;

said ski blank including a corresponding slot for receiving the second skag.

3. The water ski of claim 1, wherein the improvement includes:

means for releasably engaging said ski and ski blank to prevent disconnection thereof during skiing.

4. A convertible water ski, which comprises:

a first ski section having top and bottom surfaces, and front and rear ends;

a foot binding mounted on the top surface of said first ski section;

a second ski section relatively longer than the first ski section, said second ski section having top and bottom surfaces and front and rear ends;

a donwardly extending longitudinal first skag mounted on the bottom surface of said second ski section; and means located between the bottom surface of the first ski section and the top surface of the second ski section for interconnecting said ski sections for selective releasable disengagement by a skier during skiing, such that said second ski section can be released allowing the skier to proceed on said first ski section alone.

5. The water ski of claim 4, further including:

a downwardly extending longitudinal second skag mounted on the bottom surface of said first ski section;

said second ski section including a corresponding slot for receiving the second skag.

6. The water ski of claim 4, wherein the means interconnecting said ski sections comprises:

a plurality of snap fasteners mounted in longitudinally spaced relationship between the bottom and top surfaces of said first and second ski sections, respectively.

7. The water ski of claim 4, further including:

means for releasably engaging said ski sections to prevent disengagement thereof during skiing.

* * * * *